United States Patent [19]

Niguchi et al.

[11] 4,140,203

[45] Feb. 20, 1979

[54] ACOUSTIC DIAPHRAGM WITH POLYURETHANE ELASTOMER COATING

[75] Inventors: Hirotoshi Niguchi; Mitsuru Ieki, both of Osaka, Japan

[73] Assignee: Matsushita Electric Industrial Co., Ltd., Japan

[21] Appl. No.: 797,408

[22] Filed: May 16, 1977

[30] Foreign Application Priority Data

May 17, 1976 [JP] Japan ..... 51-56869
Jun. 18, 1976 [JP] Japan ..... 51-72333

[51] Int. Cl.[2] ..... G10K 13/00; H04R 7/00

[52] U.S. Cl. ..... 181/167; 181/166; 181/170; 428/425

[58] Field of Search ..... 428/245, 246, 217, 425, 428/263, 265; 181/170, 167, 169, 166, 180; 179/181 R, 180

[56] References Cited

U.S. PATENT DOCUMENTS

| | | | |
|---|---|---|---|
| 1,715,598 | 6/1929 | Hawley et al. | 181/168 |
| 3,093,207 | 6/1963 | Bozak | 181/167 |
| 3,196,975 | 7/1965 | Voelker | 428/425 |
| 3,285,364 | 11/1966 | Cohen | 181/167 |
| 3,328,537 | 6/1967 | Heaht | 181/169 |
| 3,467,572 | 9/1969 | Ahramjian | 428/425 |
| 3,612,783 | 10/1971 | Schneider | 181/167 |
| 3,858,680 | 1/1975 | Tsuge et al. | 181/167 |
| 3,937,905 | 2/1976 | Manger | 181/167 |

*Primary Examiner*—Michael W. Ball
*Attorney, Agent, or Firm*—Lowe, King, Price & Becker

[57] ABSTRACT

An acoustic diaphragm has a substrate of either a hard resin film or cloth of an organic material, and at least one side of the substrate is laid with a polyurethane elastomer layer. In the case of a cloth substrate, the cloth is optionally metallized by evaporation deposition of Al or Ti and/or impregnated with a thermosetting resin. The elastomer is a copolymer given by condensation of bifunctional polymeric alcohol and a glycol with a diisocyanate. This diaphragm features a flat response curve at medium to high frequencies on account of its relatively large value for Young's modulus and adequately great internal loss, and accordingly is particularly useful for tweeters.

12 Claims, 12 Drawing Figures

ACOUSTIC DIAPHRAGM WITH POLYURETHANE ELASTOMER COATING

BACKGROUND OF THE INVENTION

This invention relates to an acoustic diaphragm which is of the type using an organic sheet material as a substrate and is useful for loudspeakers.

In a loudspeaker utilizing an acoustic diaphragm as a sound-radiating means, attached to a voice coil which is operably positioned in a magnetic gap, the characteristic of the speaker primarily depends on the characteristic of the acoustic diaphragm. Loudspeakers are generally required to exhibit a high efficiency in converting an input energy into sound wave and have a flat frequency characteristic over a wide frequency range. To satisfy these requirements, an acoustic diaphragm for loudspeakers must have a small specific gravity, a large value for Young's modulus and an internal loss of an adequate scale. The specific gravity of the diaphragm greatly influences the electrical-to-acoustical energy conversion efficiency of a magnetic speaker: the smaller the specific gravity the higher the efficiency. A large Young's modulus (relative to specific gravity) and rather a large internal loss factor of the diaphragm lead to a flat frequency-output characteristic of the speaker particularly at high frequencies. It is not easy, however, to provide an acoustic diaphragm which meets these requirements all together since a diaphragm material featuring a small specific gravity generally has a small Young's modulus.

Paperboard has widely been used as the material of acoustic diaphragms with various treatments, but has not always been satisfactory in regard to the aforementioned physical properties. Particularly for tweeters, paperboard diaphragms have the disadvantage of hardly exhibiting a flat response at high frequencies due to their insufficient rigidity.

Thin metal sheet diaphragms such as of aluminum or titanium have been used particularly for tweeters to take the advantage of a large Young's modulus of such a metal relative to specific gravity. However, these metal diaphragms have excessively small internal loss factors and, hence, cannot easily be designed to exhibit a satisfactorily flat frequency-output characteristic. Besides, the use of a metal which has a greater specific gravity than, for example, paperboard causes a lowering of the efficiency of speakers.

A different type of acoustic diaphragms have been provided by utilizing a fabric sheet such as cotton cloth as the basic material of the diaphragms and coating and/or impregnating the fabric sheet with either natural rubber or a synthetic rubber. Speakers given by diaphragms of this type are fairly good in the flatness of the response in a medium frequency range but are unsatisfactory in the efficiency due to considerably large values for specific gravity of the diaphragms and, besides, are of little use as tweeters because of comparatively small values for Young's modulus of the diaphragms.

SUMMARY OF THE INVENTION

It is an object of the present invention to provide an improved acoustic diaphragm for sound-radiating devices, which diaphragm has a small specific gravity, a relatively large Young's modulus and an adequately large internal loss factor.

It is another object of the invention to provide an acoustic diaphragm which, when used in a loudspeaker, can afford the speaker a high efficiency in converting an input energy into sound wave and a flat frequency-output characteristic over a medium- to high frequency range and accordingly is particularly suitable for use in high fidelity tweeters.

An acoustic diaphragm according to the invention comprises a substrate which is at least fundamentally of an organic material and a layer of a polyurethane elastomer intimately laid on at least one side of the substrate.

The substrate may be a thin sheet of a synthetic resin, a cloth sheet of an organic material, which may optionally be impregnated and coated with a thermosetting resin, or a laminated material given by the evaporation deposition of a metal on one side of a cloth sheet of an organic material, which may optionally be impregnated and coated with a thermosetting resin.

A polyurethane elastomer useful in the present invention is a linear copolymer, which consists of a relatively soft segment given by the reaction of a bifunctional polymeric alcohol with a diisocyanate and a relatively hard segment given by the reaction of a glycol with the same diisocyanate.

In the case of the laminated substrate, aluminum or titanium is useful as the metal to be deposited by evaporation.

An acoustic diaphragm according to the invention features a considerably small specific gravity (can be made even smaller than 1.0), sufficiently large Young's modulus (can be made greater than $1.0 \times 10^{10}$ dyne/cm$^2$) and an adequately great internal loss, so that a magnetic loudspeaker utilizing this diaphragm can operate quite efficiently and can readily exhibit a practically flat response curve over a frequency range extending from about 2000 to about 20000 Hz.

DESCRIPTION OF PREFERRED EMBODIMENTS

Figure 1:
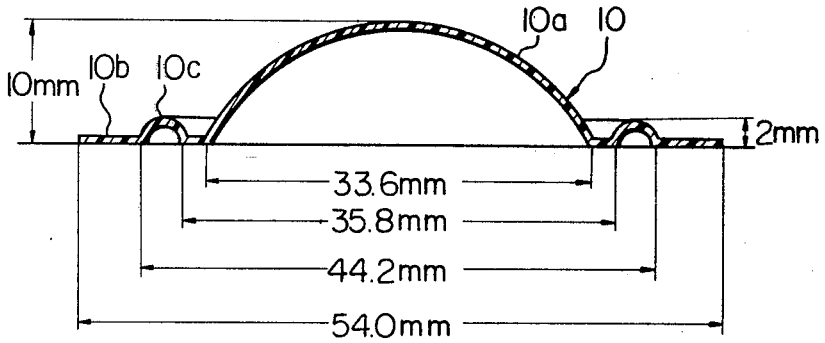
FIG. 1 is a sectional view of an acoustic diaphragm produced in hereinafter presented Example, but the diaphragm is shown in an unfinished state.

An acoustic diaphragm according to the invention is characterized primarily by the presence of a polyurethane elastomer layer on a substrate which is, at least fundamentally, of either a synthetic resin film or a cloth sheet of an organic material. The polyurethane elastomer must be a linear copolymer of the above described type. Such a copolymer is obtained by a simultaneous condensation of a bifunctional polymeric alcohol generally expressed by HO∿∿OH and a glycol $HO(CH_2)_nOH$ with a diisocyanate OCNRNCO and can generally be expressed as follows.

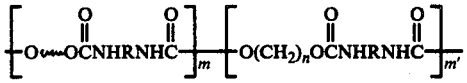

In this formula, the left side segment (originated from the polymeric alcohol) is a relatively soft one while the right side segment (originated from the glycol) is relatively hard. Accordingly the hardness of this polyurethane elastomer can be varied over a wide range by varying the proportion of the soft segment to the hard segment (meaning a variaton in the molar ratio of the polymeric alcohol to the glycol). These two types of segments may be linked alternately, respectively in some blocks or at random. It is especially preferable that the polyurethane elastomer has a Young's modulus of 5–12 $\times 10^8$ dyne/cm$^2$ and an internal loss factor of 0.23–0.3 in terms of tan δ.

There are two groups of useful bifunctional polymeric alcohols: polyester diols and polyether diols. Preferred examples are as follows.

Polyester diols:
polyethylene adipate

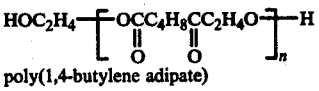

poly(1,4-butylene adipate)

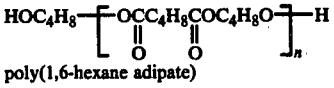

poly(1,6-hexane adipate)

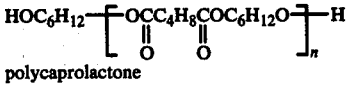

polycaprolactone

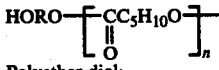

Polyether diol:

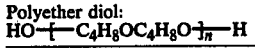

Preferred examples of glycols for the described polyurethane elastomer are as follows.

| | |
|---|---|
| ethylene glycol | $HOC_2H_4OH$ |
| tetramethylene glycol(1,4-butane diol) | $HOC_4H_8OH$ |
| 1,4-hexane diol | $HOC_6H_{12}OH$ |
| bishydroxy ethoxybenzene | |

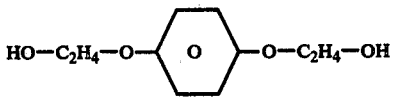

The following diisocyanates are particularly useful as a material of the described polyurethane elastomer.

4,4'-diphenylmethane diisocyanate

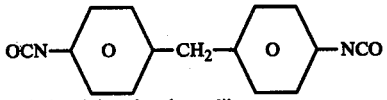

4,4'-dicyclohexylmethane diisocyanate

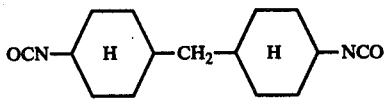

-continued isophorone diisocyanate

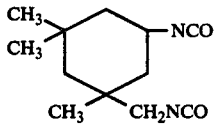

The substrate in an acoustic diaphragm of the invention has no novelty by itself and can be made from various materials. Useful materials for the substrate are classified into two groups; a group of hard resins and a group of fabrics. Examples of suitable hard resins are polyethylene terephthalate, polyesters, nonplasticized polyvinyl chloride, polycarbonate, polysulfones and polyimides. In the case of a hard resin substrate, the resin is used in the form of a thin sheet, i.e. film. In the case of a cloth substrate, an organic fibrous material takes the form of either woven cloth or non-woven cloth. Examples of suitable fibrous materials are silk, cotton, rayon, nylon and polyesters. A thin metal coating (e.g., of the order of micronmeter) of Al or Ti may be formed on one side of a cloth substrate by a vacuum evaporation technique with the purpose of enhancing the Young's modulus of the substrate. To facilitate the shaping of the substrate and the adhesion of the elastomer layer to the substrate, a fabric substrate is preferably impregnated (and naturally coated) with a thermosetting resin such as a phenol resin.

Conveniently, the coating of the substrate with the polyurethane elastomer is accomplished after the substrate is formed into a desired shape by attaching a thin sheet, i.e. film, of the elastomer to the surface of the substrate with application of heat and pressure. Alternatively, a solution of the elastomer in an organic solvent may be applied to the surface of the shaped substrate, followed by the evaporation of the solvent.

The elastomer layer may be formed on either side of the substrate (with respect to a shaped substrate). Both sides of the substrate may be laid with the elastomer if desired.

The following examples with reference to the drawings illustrate the invention.

EXAMPLE 1

A polyethyleneterephthalate resin film having a thickness of 50 μm was used as the material of the substrate. This film was molded with application of heat to make the film temperature 230° C. into a dome-shaped substrate as shown in FIG. 1. This substrate 10 consisted of a central portion 10*a* approximately in the shape of a part of a spherical surface and an annular flange portion 10*b*. An annular ridge 10*c*, which had an approximately hemispherical cross-sectional shape, was formed in the flange portion 10*b* to surround the central portion 10*a* with a short distance therebetween.

This example used a 30 μm thick film of a polyurethane elastomer as a laminating material. This elastomer was a linear copolymer as the product of condensation-copolymerization of polytetramethylene ether glycol and ethylene glycol with 4,4'-diphenylmethane diisocyanate. The molar ratio of the polytetramethylene ether glycol to ethylene glycol was 1:1. This elastomer film had a Young's modulus of 5 $\times 10^8$ dyne/cm$^2$ and exhibited an internal loss of 0.23 in terms of tan δ.

Figure 2:
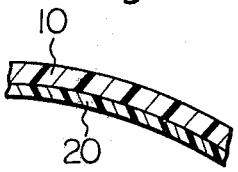
FIG. 2 is a schematic and sectional presentation of an acoustic diaphragm according to the invention for showing the construction of the diaphragm in the case of a resin film substrate.

The polyurethane elastomer film was adhered (fused) to the inner surface of the shaped substrate 10 by heatpressing at about 140° C. FIG. 2 shows the construction of the thus laminated diaphragm, wherein the elastomer film is indicated at 20. The laminated diaphragm had a total thickness of 80 μm and the following physical properties.

Specific gravity: 1.28
Young's modulus: $3.1 \times 10^{10}$ dyne/cm$^2$
Internal loss (tan δ): 0.05

Figure 6:
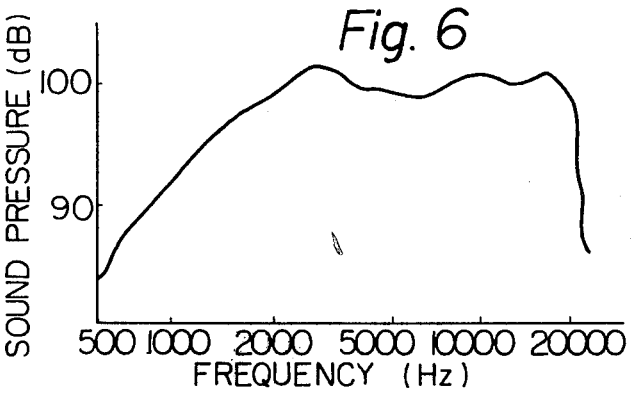
FIGS. 6–9 are frequency-output characteristic curves of a magnetic loudspeaker having a diaphragm according to the invention obtained by four differently varying the construction of the diaphragm.

FIG. 6 shows the frequency-output characteristic of a tweeter which employed the diaphragm of Example 1. The sound pressure level was measured in front of the diaphragm at a distance of 50 cm.

EXAMPLE 2

Figure 3:
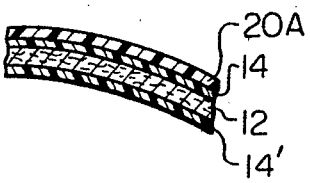
FIGS. 3–5 show three different examples of the construction of the diaphragm in the case of a cloth substrate.

A silk-cloth having a density of 40 g/cm$^2$ was used as the basic material of the substrate of an acoustic diaphragm. This silk-cloth was immersed in a 10 Wt% solution of a phenol resin and then dried. The resin-impregnated silk-cloth, which served as the substrate in this Example, was molded into the dome shape of FIG. 1 at a temperature of 200° C. so as to cure the resin. In FIG. 3, reference numeral 12 indicates the resin-impregnated silk cloth. As the result of the resin impregnation, both sides of the silk cloth 12 were coated with the phenol resin layers 14 and 14'.

Then a polyurethane elastomer film 20A, which was of the same material as the elastomer film 20 used in Example 1 but had a thickness of 50 μm, was laminated onto the outer surface of the shaped substrate (that is, on the outer phenol resin layer 14) by the use of a vacuum molding-laminating apparatus with application of heat. The thus produced diaphragm was 140 μm in total thickness and had the following physical properties.

Specific gravity: 0.87
Young's modulus: $1.2 \times 10^{10}$ dyne/cm$^2$
Internal loss (tan δ): 0.025

Figure 7:
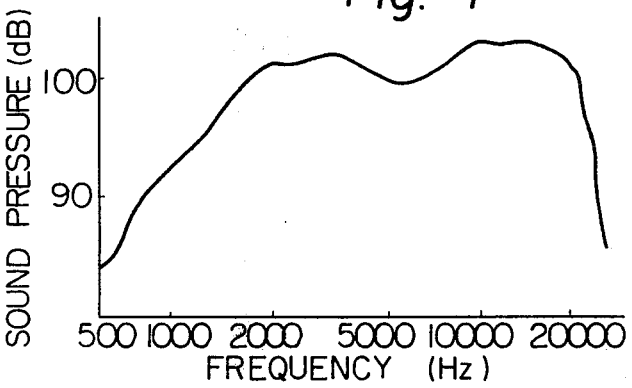

A tweeter which was identical with the tweeter tested in Example 1 except for the use of the diaphragm of Example 2 exhibited a frequency-output characteristic as shown in FIG. 7.

EXAMPLE 3

Figure 4:
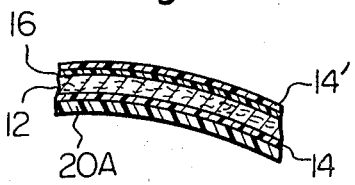

Referring to FIG. 4, one side of the silk-cloth 12 used in Example 2 was metallized by an aluminum coating 16 which was formed by a vacuum evaporation technique to have a thickness of about 1 μm. The metallized silk-cloth 12 was then impregnated with the phenol resin in accordance with Example 2, so that the aluminum layer 16 too was coated with the resin layer 14'. The metallized and resin-impregnated silk-cloth 12 was heat-molded into the dome shape of FIG. 1 such that the metallized side of the cloth 12 turned into the outside of the dome. Then the polyurethane elastomer film 20A of Example 2 (50 μm thick) was fused onto the inside of the dome-shaped substrate (that is, onto the phenol resin layer 14 formed directly on the silk-cloth 12) by a vacuum molding-laminating technique as in Example 2.

The acoustic diaphragm of Example 3 had a total thickness of 143 μm and the following physical properties.

Specific gravity: 0.98
Young's modulus: $1.5 \times 10^{10}$ dyne/cm$^2$
Internal loss (tan δ): 0.022

Figure 8:
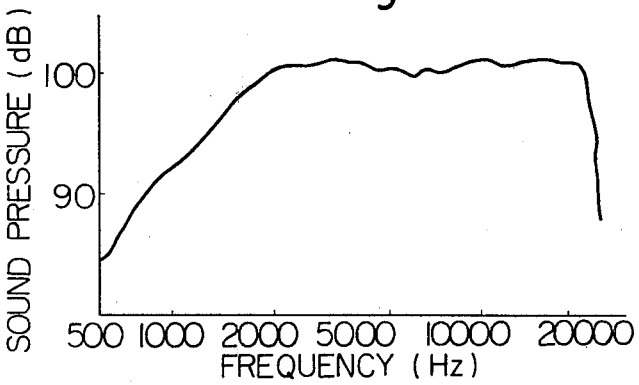

FIG. 8 shows the frequency-output characteristic of a tweeter which used the diaphragm of Example 3 but otherwise was identical with the tweeter tested in Example 1.

EXAMPLE 4

Figure 5:
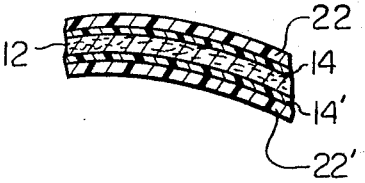

Example 2 was repeated, using the same silk-cloth 12 and the phenol resin, till the shaping of the resin-impregnated silk-cloth. An elastomer solution was prepared by dissolving the polyurethane elastomer employed in Example 1 in methyl ethyl ketone, and this solution was applied onto both sides of the resin-impregnated silk-cloth 12, followed by the evaporation of the solvent, to give elastomer coatings 22 and 22' as shown in FIG. 5 on the both phenol resin layers 14 and 14'. Each of these elastomer coatings 22 and 22' was about 25 μm thick, so that the total thickness of the diaphragm was 125 μm. The solvent for the preparation of a polyurethane elastomer solution is not limited to methyl ethyl ketone. Tetrahydrofuran is an example of other useful solvents.

Figure 9:
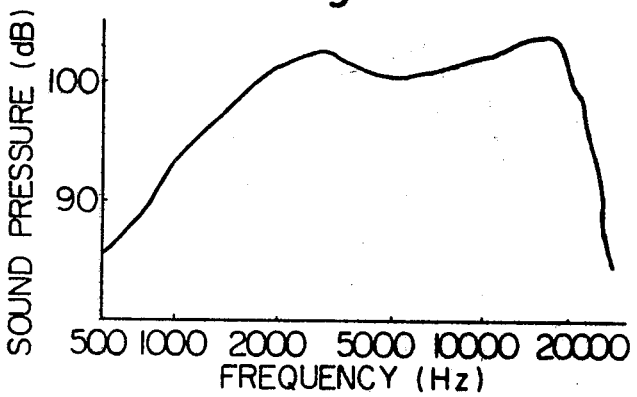

The physical properties of the diaphragm of Example 4 was as follows, and the frequency-output characteristic of a tweeter which utilized this diaphragm is shown in FIG. 9.

Specific gravity: 0.79
Young's modulus: $1.3 \times 10^{10}$ dyne/cm$^2$
Internal loss (tan δ): 0.03

As seen in FIGS. 6–9, an acoustic diaphragm of the invention can give a tweeter which exhibits an excellent efficiency and a practically flat response curve in a medium- to high frequency range.

Among various types of conventional acoustic diaphragms, one type is characterized by the impregnation and/or coating of a fibrous sheet material with rubber. An acoustic diaphragm of the invention may superficially seem analogous to this type of conventional diaphragms. However, a polyurethane elastomer used in the present invention is fundamentally different from rubbers in that no vulcanization (the introduction of sulfur) is employed. For example, butadiene rubbers have a Young's modulus of 2–6 $\times 10^8$ dyne/cm$^2$ and tan δ of 0.15–0.2. A diaphragm according to the invention can have a larger value for Young's modulus than conventional diaphragms using rubber as an impregnation and coating material. To demonstrate the difference of a diaphragm of the invention from conventional diaphragms of the described type, a diaphragm having the shape of FIG. 1 was produced by the use of cotton cloth as the basic material and impregnating this cloth with butadiene rubber. This diaphragm had the following physical properties.

Specific gravity: 1.5
Young's modulus: $6 \times 10^9$ dyne/cm$^2$
Internal loss (tan δ): 0.020

Figure 10:
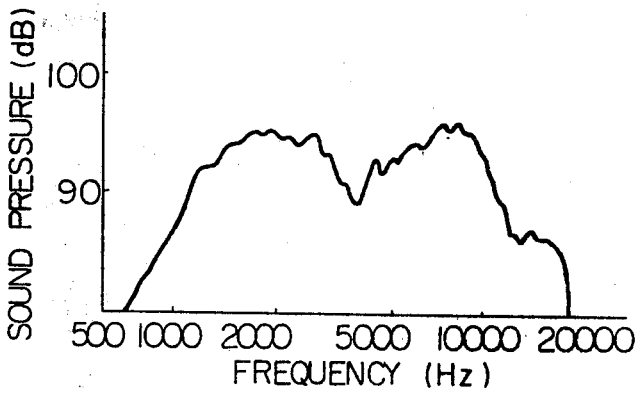
FIG. 10 is a frequency-output characteristic curve of a magnetic speaker using a conventional diaphragm.

FIG. 10 shows the result of the frequency-output test made on the same tweeter as in Examples but using this diaphragm.

A vacuum molding-laminating technique which is useful for intimately attaching an elastomer film to a cloth-base substrate will be described with reference to FIGS. 11 and 12.

Figure 11:
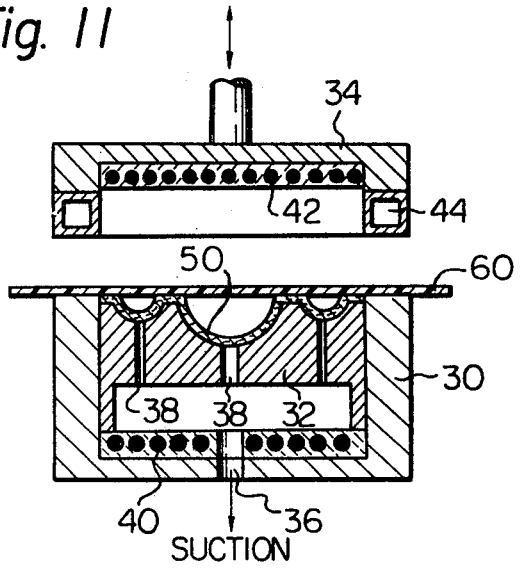
FIG. 11 is a schematic and sectional view of a vacuum molding apparatus useful for the production of a diaphragm according to the invention.

A vacuum molding-laminating apparatus of FIG. 11 has a stationary die holder 30, a dome-shaped female die 32 disposed in the molder 30 and a reciprocable lid member 34 arranged opposite to the shaped face of the female die 32. The die holder 30 has a vent port 36 for evacuation of the interior of the holder 30, and a plurality of narrow vent holes 24 are formed in the female die 32 so as to provide fluidic communication between the shaped surface and the vent port 36. The die 32 is provided with a heater 40 in its base portion. The lid member 34 too has a heater 42. A lower end portion (facing the dies 32) of this member 34 takes the form of a cylindrical wall such that a space is left between the upper end of the die holder 30 and the heater-embeded part of the lid member 34 and that the cylindrical wall does not contact the die 32 but surrounds it when the lid member 34 contacts the die holder 30. A cooling water duct 44 is embedded in this cylindrical wall.

In operation, a dome-shaped substrate 50 such as the resin-impregnated silk-cloth 12 in Example 2 is placed in the dome-shaped female die 32, and a flat polyurethane elastomer film 60 (corresponds to the film 20A in Example 2) is placed on the die holder 30 so as to cover the die 32. In this state, the lid member 34 is lowered so as to circumferentially clamp the elastomer film 60 between the die holder 30 and the end face of the cylindrical wall of the lid member 34. Then current is passed through the heaters 40 and 42 such that the die 32 and the elastomer film 60 are heated respectively to 100° C. and 190° C. The elastomer film 60 softens in about 2 sec at this temperature. Then the interior of the die holder 30 is evacuated by suction of air through the vent port 36. As a result, air is aspirated from the cavities of the die 32 through the substrate 50 and the vent holes 38. Then the softened elastomer film 60 is compressed against the substrate 50 in the die 32 by the action of the atmospheric pressure on its upper surface. Consequently the elastomer film 60 comes into intimate contact with the substrate 50 and is molded in conformance with the shape of the substrate 50. The contact of the softened elastomer film 60 with the substrate 50 occurs so intimately that the lower side of the elastomer film 60 somewhat intrudes into the substrate 50. Thereafter the heating is stopped so as to solidify the shaped elastomer film 60.

Figure 12:
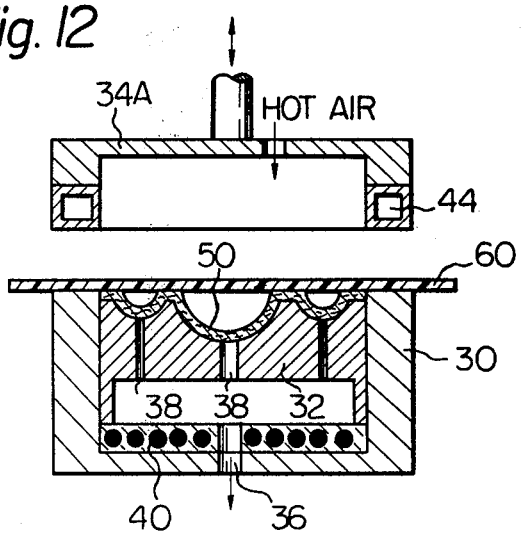
FIG. 12 shows a minor modification of the molding apparatus of FIG. 11

As a modification of the apparatus of FIG. 11, a reciprocable lid member 34A of a vacuum-laminating apparatus shown in FIG. 12 has a hot-air inlet 46 in place of the heater 42 in the lid member 34 of FIG. 11. The die 32 and the die holder 30 in FIG. 12 are identical with ones in FIG. 11.

When the elastomer film 60 is clamped between the die holder 30 and the lid member 34A, a hot air of 200° C. is blown into the interior of the lid member 34A (accordingly against the flat elastomer film 60) for 3 sec. Then the hot-air is pressurized to 2 atm and maintained at this pressure for 3 sec. Thereafter the pressure of the hot-air is raised to 16 atm to apply heat and pressure to the elastomer film 60 for additional 2 sec. Through these procedures, the elastomer film 60 is brought into intimate contact with the shaped substrate 50. Since the hot-air is greatly pressurized, the hot-air blown into the lid member 34A can gradually be discharged from the apparatus through the substrate 50, vent holes 38 and the vent port 36 without the need of evacuating the interior of the die holder 30.

Alternatively, the pressure of the hot-air may be limited to about 1.5 atm with simultaneous application of a suction pressure of about 80 mmHg to the interior of the die holder 30.

The temperatures, pressures and amounts of time given in the foregoing explanation of the laminating operation are all exemplary and should be modified in dependence on the material and thickness of the substrate 50 and the elastomer film 60.

What is claimed is:

1. In a loudspeaker comprising an acoustic diaphragm as a sound radiating means attached to a voice coil, the improvement wherein the acoustic diaphragm comprises a substrate at least fundamentally of an organic material and a solid non-cellular film of a polyurethane elastomer intimately laminated onto said substrate, said polyurethane elastomer being formed by the condensation of polytetramethylene ether glycol and ethylene glycol with 4',4'-diphenylmethane diisocyanate, said elastomer having a Young's modulus in the range from $5 \times 10^8$ to $12 \times 10^8$ dyne/cm$^2$ and an internal loss factor of 0.23 to 0.3 in terms of tan $\delta$.

2. An acoustic diaphragm as claimed in claim 1, wherein said substrate is a thin sheet of a hard synthetic resin.

3. An acoustic diaphragm as claimed in claim 1, wherein said substrate is a cloth of an organic fibrous material.

4. An acoustic diaphragm as claimed in claim 3, wherein said cloth is of a woven fabric.

5. An acoustic diaphragm as claimed in claim 3, wherein said cloth is a non-woven cloth.

6. An acoustic diaphragm as claimed in claim 1, wherein said substrate is a cloth of an organic fibrous material, said cloth being impregnated and coated with a thermosetting resin.

7. An acoustic diaphragm as claimed in claim 6, wherein said cloth is a silk cloth, which is impregnated with a thermosetting resin, as a substrate, and a thin sheet of a polyurethane elastomer laminated onto at least one side of said substrate.

8. An acoustic diaphragm as claimed in claim 7, wherein said thermosetting resin is a phenol resin.

9. An acoustic diaphragm as claimed in claim 1, wherein said substrate comprises a cloth of an organic fibrous material and a metal film laminated onto at least one side of said cloth by evaporation deposition, said metal being selected from the group consisting of Al and Ti.

10. An acoustic diaphragm as claimed in claim 9, wherein said cloth is impregnated with a thermosetting resin.

11. In a loudspeaker comprising an acoustic diaphragm as a sound radiating means attached to a voice coil, the improvement wherein the acoustic diaphram comprises a substrate of a silk cloth, at least one side of said silk cloth being laminated with a film of a metal selected from the group consisting of Al and Ti formed by evaporation deposition, said silk cloth being impregnated with a thermosetting resin, and a solid non-cellular film of a polyurethane elastomer intimately laminated onto said substrate, said polyurethane elastomer being formed by the condensation of a polytetramethylene ether glycol and ethylene glycol with 4,4'-diphenylmethane diisocyanate said elastomer having a Young's modulus in the range from $5 \times 10^8$ to $12 \times 10^8$ dyne/cm$^2$ and an internal loss factor of 0.23 to 0.3 in terms of tan $\delta$.

12. An acoustic diaphragm as claimed in claim 11, wherein said thermosetting resin is a phenol resin, only one side of said cloth being laminated with an aluminum film, said thin sheet of said elastomer being laminated only on the other side of said cloth.

* * * * *